US005743038A

United States Patent [19]

Soto

[11] Patent Number: 5,743,038

[45] Date of Patent: Apr. 28, 1998

[54] THREE-DIMENSION SHADOW BOX DISPLAY DEVICE

[76] Inventor: David Soto, 554 21st St., Apt. #1, San Pedro, Calif. 90731

[21] Appl. No.: 593,238

[22] Filed: Oct. 19, 1995

[51] Int. Cl.[6] ..... A47G 1/06

[52] U.S. Cl. ..... 40/743; 40/427; 40/219

[58] Field of Search ..... 40/743, 900, 219, 40/427

[56] References Cited

U.S. PATENT DOCUMENTS

| | | | |
|---|---|---|---|
| 2,042,268 | 5/1936 | Michaus | 40/219 |
| 2,286,246 | 6/1942 | Yearta | 40/219 |
| 5,214,539 | 5/1993 | Sorko-Ram | 40/900 X |

*Primary Examiner*—Kenneth J. Dorner
*Assistant Examiner*—Cassandra Davis
*Attorney, Agent, or Firm*—Daniel R. Kimbell

[57] ABSTRACT

A three-dimension shadow box. It has a frontwardly lying sheet of transparent glass and a rearwardly lying mirror placed in a generally parallel orientation in a box structure. Graphic indicia is positioned on the frontwardly lying glass, and the graphic indicia has a first layer, having a first color and pattern, viewable only from the front, and a second layer, having a second color and pattern, viewable as the reflection off of the mirror. Two-dimensional visual indicia is placed adjacent to the mirror. The graphic indicia is viewable from the front of the frontwardly lying sheet of glass and a reflection of a rear side of the graphic indicia reflects off of the rearwardly lying mirror so as to appear as lying behind the two-dimensional visual indicia, giving the two-dimensional visual indicia the appearance of floating in the box structure.

18 Claims, 2 Drawing Sheets

FIG. 1
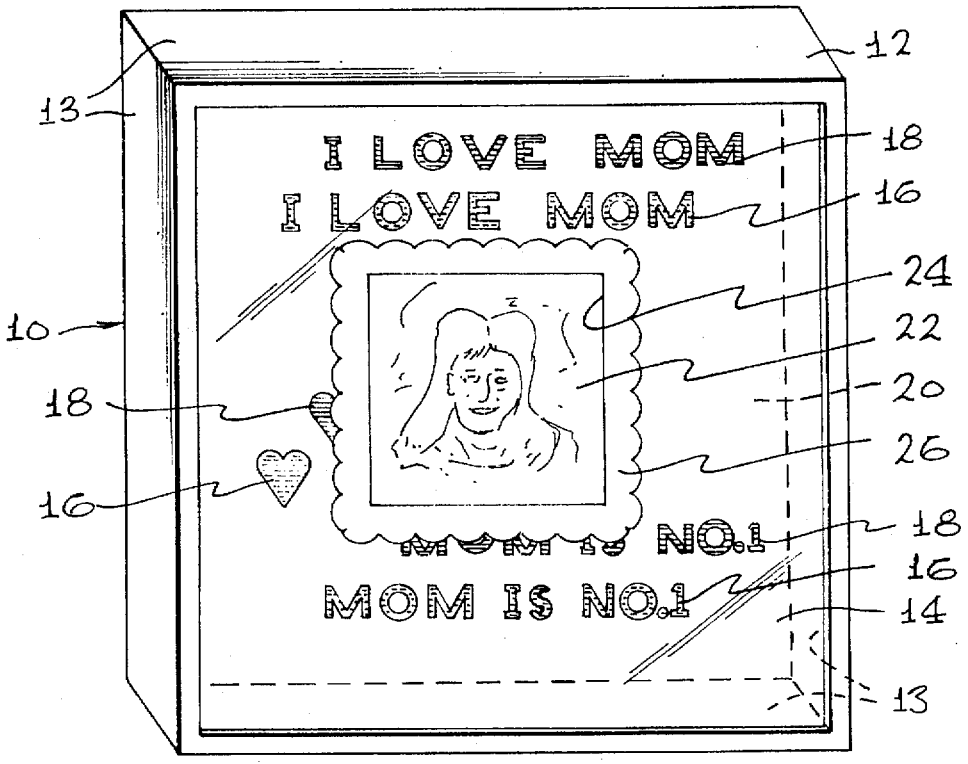
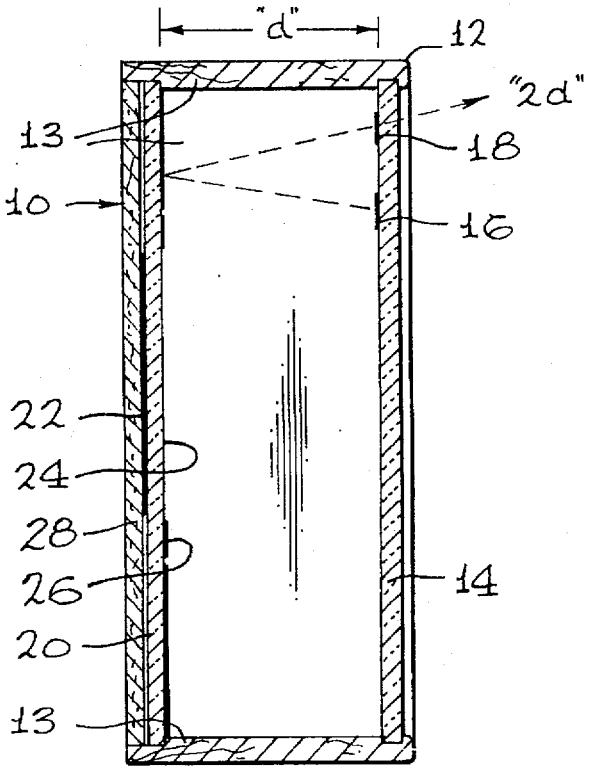
FIG. 2

THREE-DIMENSION SHADOW BOX DISPLAY DEVICE

BACKGROUND OF THE INVENTION

1. Field of the Invention

This invention relates to the field of display structures, and more particularly to a shadow box device for displaying cards, photographs, and other two dimension items desired by a user to be displayed in a box structure but give the impression of floating in space in three-dimensions within the box structure.

2. Description of the Prior Art

There are numerous patents disclosing mirror box structures which utilize a partially mirrored front mirror and a rear mirror, with an object or image placed within the space between the mirrors, or against the rear mirror. Included with this description are the following references.

French Patent No. 815,956 to Calimani discloses a lighted mirror display box which has a front transparent mirror, a rear non-transparent mirror upon which appears an image, and a lamp behind the non-transparent mirror. The lamp illuminates the space between the two mirrors, and causes the image to reflect back and forth to give the impression of multiple images.

British Patent No. 1,229,912 to Geoffroy discloses a multiple reflection display device which is very similar to the Calimani patent and likewise employs a front, partially reflecting mirror and a rear convex mirror, with items, such as foliage and a figurine in between. Mirrors surround the sides walls. This space is lite up by a lamp, and the effect is of multiple images.

French Patent No. 77 14649 to Blanchet discloses a luminous sign display which uses two parallel mirrors, the first being a half mirrored front surface and a rear mirror which has un-mirrored regions which correspond to the sign to be displayed. A light is placed behind the rear mirror to create the succession of images.

There are many other patents in this art field including the following:

British Patent No. 527,266 to White

Swiss Patent No. 260,755 to Willi

French Patent No. 777.429 to Spielmann

U.K. Patent Application No. GB 2,058,428

U.S. Pat. No. 2,114,711 to Horinstein

While the aforementioned prior art devices provide interesting visual effects, they do not disclose an effect wherein a single image, i.e. a photograph, image printing on a card, painting, etc. will be made to appear to float in a box, when it is actually secured to a back of the 3-D light box. There is accordingly a need for three-dimension shadow box of this kind.

BRIEF SUMMARY OF THE INVENTION

The principal object of the invention is to provide a three-dimension with photographs, pictures, momentous, and other images mounted adjacent a rear mirror wall, yet which appears to float in the box.

Another object of the invention is to provide a shadow box which needs no internal lighting fixtures, and which is simple in design, and inexpensive to manufacture.

Yet another object of the invention is to provide a shadow box which appears to have a depth which is twice as deep as its actual depth.

A further object of the invention is to provide a shadow box which permits a users to install his or her own photographs, pictures, momentous, and other images adjacent a rear mirror wall to customize the shadow box.

These and other objects of the invention are accomplished by providing a shadow box having a front transparent sheet, upon which is imprinted visual indicia such as text or graphic images, a rearwardly lying mirror which is spaced away at a distance "d" from the front transparent sheet, a box enclosure for the front image bearing sheet and rear mirror. A photograph, print, collecting card, or other visual image bearing card, which is smaller than the rear mirror, is either mounted directly on top of the mirror, or preferably, the mirror can have an un-mirrored "window", and the visual image bearing item can be mounted behind it, in the form of a picture frame. The visual indicia on the front transparent sheet will reflect off of the rearwardly lying mirror. The reflected indicia will, from most angles of view, looks as though it extends behind the item on the mirror. The "floating effect" is enhanced when the visual indicia imprinting on the front sheet is made in two layers of contrasting colors. For example, a first layer lying directly on the glass can be in silver, and a second layer overlaying the front layer, can, for example be blue. Thus, from the front, the view will see the imprinting in silver, but will see the blue indicia reflected off of the rearwardly lying mirror. This further enhances the floating effect. For greater versatility, the visual indicia on the front wall can be provided in the form of sticker and decal which the end user can apply himself or herself to customize the shadow box, i.e. to spell a name.

BRIEF DESCRIPTION OF THE DRAWINGS

FIG. 1 is a front perspective view of the shadow box of the invention.

FIG. 2 is a cross-sectional view of the shadow box through view lines 2—2 of FIG. 1.

DETAILED DESCRIPTION OF THE INVENTION

Figure 3:
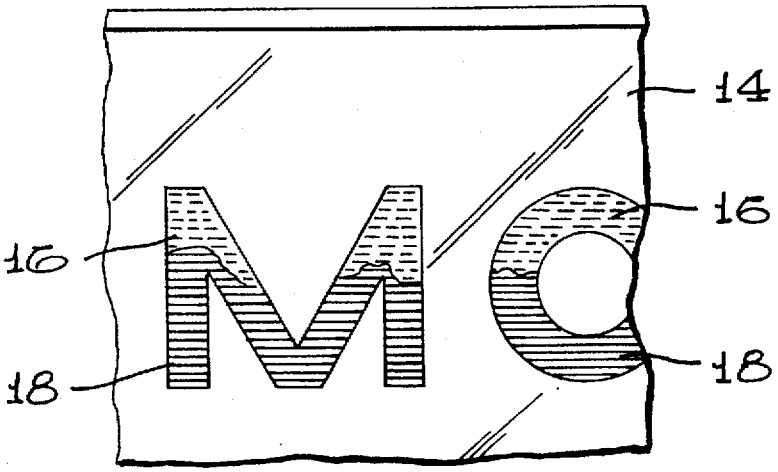
FIG. 3 is a partially exposed rear view of the front sheet showing the two layers of indicia placed on the glass.
Figure 4:
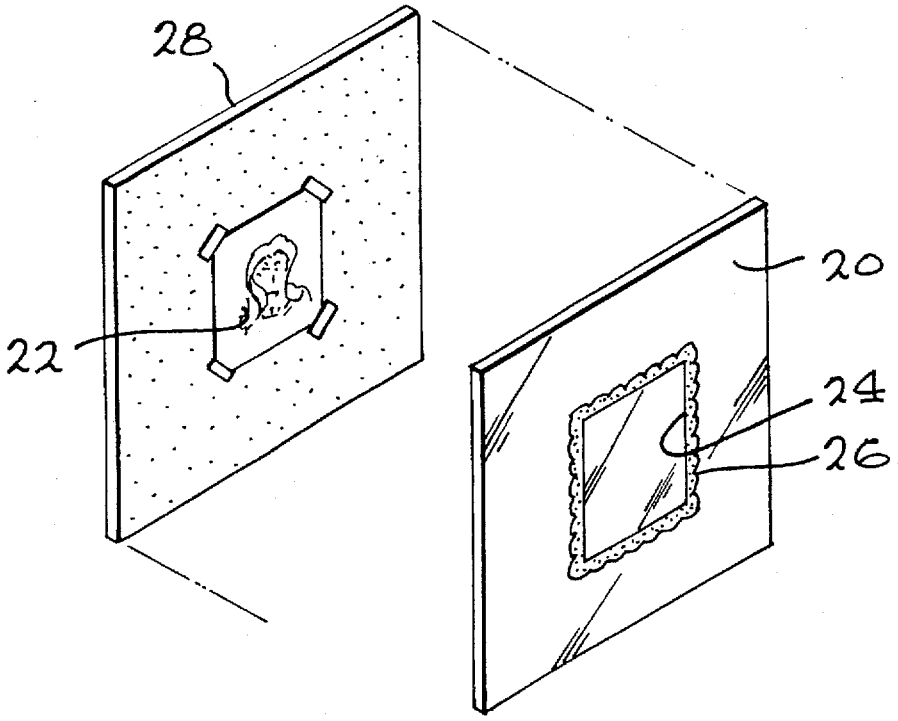
FIG. 4 is an exploded front perspective view of a mirror and print holder.

Referring first to FIGS. 1 and 2, a front perspective and cross-sectional views are respectively shown of the shadow box 10 of the invention. It has a case or box structure 12 with a total depth of "d" and perimeter side walls 13. These side walls 13 are not mirrored. The front of the box structure 12 has a frontwardly lying sheet of transparent material 14, i.e. glass or plastic, upon which is placed graphic indicia or wording 16 in a first color. The same graphic indicia or wording 18 appears to be present at a distance "2*d*" behind the frontwardly lying graphic indicia 16, and can have the same color, but preferably are of a different color or pattern as the graphic indicia or wording 16. In FIG. 1, the text "I LOVE MOM", "MOM IS NO. 1", and a heart shaped symbol are shown for both graphic indicia and wording 16 and 18. In FIG. 1, they appear in the colors silver and blue, respectively, but they can be of any number of colors and a mix of colors or patterns. Located a distance "d" behind the sheet of transparent material 20 is a flat reflective surface, such as a sheet of mirror plated glass to create a mirror, which creates a back wall of the 3-D shadow box 10. The frontwardly lying sheet of transparent material 14 and rearwardly lying reflective surface 20 preferably are spaced apart in a generally parallel orientation. In the preferred embodiment, a photograph, a print, a collecting card, or other visual image bearing card, or other two-dimensional visual indicia or artifact 22, which is smaller than the rear mirror 20, is either mounted directly on top of the mirror 20, or preferably, the mirror can have an un-mirrored "window" 24 and the two-dimensional visual indicia 22 can be mounted behind the window 24 and seen through the un-mirrored window 24, so that the image is framed like a picture frame, (See FIG. This approach allows a users to place any picture, card, photograph, or any other two-dimensional visual indicia 22 he or she desires in the shadow box 10 to create a truly custom display. To enhance such a "picture framing", the front of the mirror around the un-mirrored window 24 can be stenciled with, for example, a framing indicia 26. Alternately, a graphic image can be imprinted or mounted directly on the front side of the mirror 20 without leaving an un-mirrored window (not shown.)

The different graphic indicia and wording 16 and 18, although they appear to be on the front of shadow box on the sheet of transparent material 14, and spaced a distance 2*d* behind the sheet of transparent material 14, are actually created by the same graphic indicia and wording. The optical illusion results from the reflection of light off of the back side of the first graphic indicia 16 onto the flat mirror surface 20, and back again to the viewer's eyes is seen as graphic indicia 18, which "looks" like it is at a distance "2*d*" from the front graphic indicia 16. The "floating effect" is further enhanced when the visual indicia imprinting on the front sheet is made in two layers of contrasting colors. For example, a first layer lying directly on the glass (which is seen by the viewer as graphic indicia or wording 16) can be in silver, and a second layer overlaying the front layer (which is seen by the view as the graphic indicia 18 reflected off of the mirror 20) can, for example, be blue. Thus, from the front, the view will see the graphic indicia 16 in silver, but will see the blue graphic indicia 18 reflected off of the rearwardly lying mirror 20. This reflected graphic indicia 18 will, depending upon the angle at which the view looks at the 3-D shadow box 10, appear to extend behind the two-dimensional visual indicia 22 on the rearwardly lying mirror 20. This further enhances the floating effect. For greater versatility, the graphic indicia 16 and 18 on the front sheet of transparent material 14 can be provided in the form of stickers and decals which the end user can apply himself or herself to customize the shadow box, i.e. to spell a name.

A sheet of cardboard, masonite, plywood, chipboard, or other sheet material 28 can be placed behind the mirror 20 and the two-dimensional visual indicia 22, much like a picture frame to allow easy access to the two-dimensional visual indicia 22.

The drawings and the foregoing description are not intended to represent the only form of the invention in regard to the details of this construction and manner of operation. In fact, it will be evident to one skilled in the art that modifications and variations may be made without departing from the spirit and scope of the invention. Although specific terms have been employed, they are intended in a generic and descriptive sense only and not for the purpose of limitation, the scope of the invention being delineated in the following the claims which follow.

I claim:

1. A three-dimension shadow box, comprising:

a frontwardly lying transparent and non-mirrored sheet;

a rearwardly lying reflective surface;

a means for retaining said frontwardly lying transparent sheet and said rearwardly lying reflective surface in a spaced apart orientation;

graphic indicia positioned on said frontwardly lying transparent sheet; and visual indicia adjacent said rearwardly lying reflective surface; wherein said graphic indicia is viewable from the front of said transparent frontwardly lying sheet and a reflection of a rear side of said graphic indicia reflects off of said rearwardly lying reflective surface so as to appear as lying behind said visual indicia, giving the visual indicia the appearance of floating.

2. The three-dimension shadow box of claim 1, wherein said means for retaining said frontwardly lying transparent sheet and said rearwardly lying reflective surface in a spaced apart orientation comprises a box structure.

3. The three-dimension shadow box of claim 2, wherein said frontwardly lying transparent sheet and said rearwardly lying reflective surface are spaced apart in a generally parallel orientation in said box structure.

4. The three-dimension shadow box of claim 1, wherein said graphic indicia positioned on said frontwardly lying transparent sheet comprises printing placed on a back side of said frontwardly lying transparent sheet.

5. The three-dimension shadow box of claim 1, wherein said graphic indicia has a first layer, having a first color and pattern, viewable only from a front of said frontwardly lying transparent sheet, and a second layer, having a second color and pattern, different from said first color and pattern, viewable as a reflection off of said rearwardly lying reflective surface.

6. The three-dimension shadow box of claim 1, wherein said rearwardly lying reflective surface comprises a sheet of flat glass with mirror plating.

7. The three-dimension shadow box of claim 6, wherein said sheet of glass has an un-mirrored window, from behind which is placed said visual indicia.

8. The three-dimension shadow box of claim 1, wherein said visual indicia comprises printing directly on a front surface of said rear reflective surface.

9. The three-dimension shadow box of claim 1, wherein said graphic indicia comprise stickers which are adapted to be placed on said frontwardly lying transparent sheet.

10. The three-dimension shadow box of claim 1, wherein said frontwardly lying transparent sheet comprises glass.

11. The three-dimension shadow box of claim 1, wherein said visual indicia comprises a two-dimensional visual image bearing artifact.

12. A three-dimension shadow box, comprising:

a frontwardly lying transparent and non-mirrored sheet;

a rearwardly lying reflective surface;

a box structure for retaining said frontwardly lying transparent sheet and said rearwardly lying reflective surface in a spaced apart orientation;

graphic indicia positioned on said frontwardly lying transparent sheet, said graphic indicia having a first layer, with a first color and pattern, viewable only from a front of said frontwardly lying transparent sheet, and a second layer, having a second color and pattern, viewable as a reflection off of said rearwardly lying reflective surface; and two-dimensional visual indicia adjacent said rearwardly lying reflective surface; wherein said first layer of said graphic indicia is viewable from a front of said transparent frontwardly lying sheet and a reflection of said second layer of said graphic indicia reflects off of said rearwardly lying reflective surface so as to appear as lying behind said two-dimensional visual indicia, giving said two-dimensional visual indicia the appearance of floating.

13. The three-dimension shadow box of claim 12, wherein said frontwardly lying transparent sheet comprises glass.

14. The three-dimension shadow box of claim 12, wherein said rearwardly lying reflective surface comprises a sheet of mirrored glass with an un-mirrored window, from behind which is placed said two-dimensional visual indicia.

15. The three-dimension shadow box of claim 12, wherein said two-dimensional visual indicia comprises printing directly on a front surface of said rearwardly lying reflective surface.

16. The three-dimension shadow box of claim 12, wherein said frontwardly lying transparent sheet and said rearwardly lying reflective surface are spaced apart in a generally parallel orientation in said box structure.

17. The three-dimension shadow box of claim 2, wherein said graphic comprise stickers adapted to be placed on said frontwardly lying transparent sheet.

18. A three-dimension shadow box, comprising:

a frontwardly lying transparent and non-mirrored sheet;

a rearwardly lying mirrored sheet with an unmirrored window;

a means for retaining said frontwardly lying transparent sheet and said rearwardly lying mirrored sheet in a spaced apart orientation;

graphic indicia positioned on said frontwardly lying transparent sheet; and visual indicia adjacent said rearwardly lying mirrored sheet in said unmirrored window; wherein said graphic indicia is viewable from a front of said frontwardly lying mirrored sheet and a reflection of said graphic indicia reflects off of said rearwardly lying reflective surface so as to appear as lying behind visual indicia, giving said visual indicia the appearance of floating.

* * * * *